US012687156B2

(12) United States Patent
Wilson

(10) Patent No.: US 12,687,156 B2
(45) Date of Patent: Jul. 21, 2026

(54) ACCUMULATOR FOR PREVENTION OF HYDRAULIC PUMP CAVITATION

(71) Applicant: The Boeing Company, Arlington, VA (US)

(72) Inventor: Barry Allan Wilson, Edmond, OK (US)

(73) Assignee: The Boeing Company, Arlington, VA (US)

( * ) Notice: Subject to any disclaimer, the term of this patent is extended or adjusted under 35 U.S.C. 154(b) by 0 days.

(21) Appl. No.: 18/805,636

(22) Filed: Aug. 15, 2024

(65) Prior Publication Data

US 2026/0049604 A1 Feb. 19, 2026

(51) Int. Cl.

| | |
|---|---|
| ***F04B 11/00*** | (2006.01) |
| ***F04B 53/06*** | (2006.01) |
| *F04B 13/00* | (2006.01) |

(52) U.S. Cl.

CPC ..... *F04B 11/0033* (2013.01); *F04B 53/06* (2013.01); *F04B 13/00* (2013.01)

(58) Field of Classification Search

CPC .... F04B 11/0008; F04B 11/003; F04B 53/06; F04B 13/00; B64D 29/00; B64D 29/02; B64D 29/04; F02C 7/32; F05D 2220/50; F15B 1/02; F15B 1/021; F15B 1/26; F15B 1/265

See application file for complete search history.

(56) References Cited

U.S. PATENT DOCUMENTS

| | | | | |
|---|---|---|---|---|
| 4,371,318 | A | 2/1983 | Kime | |
| 4,793,774 | A * | 12/1988 | Bradt | F04B 1/148 417/203 |
| 5,845,483 | A * | 12/1998 | Petrowicz | F02C 7/262 60/788 |
| 2018/0274563 | A1 * | 9/2018 | Elving | B64C 13/36 |

FOREIGN PATENT DOCUMENTS

| | | | |
|---|---|---|---|
| WO | WO-2023198987 A1 * | 10/2023 | F01D 7/00 |

* cited by examiner

*Primary Examiner* — Loren C Edwards
(74) *Attorney, Agent, or Firm* — Hanley, Flight and Zimmerman, LLC

(57) ABSTRACT

To prevent cavitation damage to a hydraulic fluid pump, a low pressure accumulator is fluidly connected to the suction line of an engine-driven hydraulic pump to boost suction line pressures during instantaneous demands for higher pump flows. The accumulator acts as a localized reservoir for the engine-driven pump to avoid deleterious pressure drops which give rise to pump cavitation. In one disclosed architectural arrangement, the accumulator is directly coupled to the suction line of an aircraft engine-driven hydraulic pump to supply hydraulic fluid upon demand, with both the pump and accumulator contained within an engine nacelle of an aircraft. The low pressure accumulator operates fully independently of a remote main aircraft accumulator, and while the main accumulator operates at thousands of psi, and requires periodic service, the low pressure accumulator operates at less than 30 psi, and is formed of a maintenance-free construction.

23 Claims, 5 Drawing Sheets

ACCUMULATOR FOR PREVENTION OF HYDRAULIC PUMP CAVITATION

STATEMENT REGARDING FEDERALLY SPONSORED RESEARCH OR DEVELOPMENT

This invention was made with Government support under FA8628-19-D-1000; D.O: FA8107-20-F-0001 awarded by Department of Defense. The government has certain rights in this invention.

TECHNICAL FIELD

This disclosure relates to provision of an accumulator within a nacelle of an aircraft engine to prevent cavitation in a hydraulic pump, also located within the nacelle. More specifically, the disclosure relates to placement of the accumulator at the pump suction line to mitigate against cavitation-inducing pressure drops upon instantaneous activations of the pump, particularly when the pump is being fed from a remote hydraulic fluid reservoir.

BACKGROUND

Hydraulic fluid reservoirs as employed in hydraulic fluid systems of commercial aircraft are typically placed remotely from engine driven hydraulic pumps due to space limitations, as well as regulations requiring that reservoirs be installed in non-hazardous areas. The reservoirs may be installed as much as fifty feet away from the pump, resulting in both frictional loss and high fluid inertance (herein defined as resistance to acceleration due to inertia).

On the other hand and for efficiency purposes, the engine driven hydraulic pumps are placed immediately adjacent the engine, normally within nacelles of commercial aircraft engines. The remote distances of the reservoirs from the pumps can give rise to substantial line pressure losses, particularly when spontaneous activations of the pumps produce instantaneous acceleration of hydraulic fluids from low to high flow conditions. Accompanying momentary rapid decreases in pressure occurring within the hydraulic pump suction lines will result in cavitation, which over time can result in pump failures.

The issue of hydraulic pumps being prone to pressure drops at their suction ports when fed from remote reservoirs is well known. Among others, common solutions for addressing suction line pressure drops have included increasing hydraulic system reservoir pressures, as well as installing gear pumps between the reservoirs and the pumps to boost pressures in the suction lines. These traditional solutions have resulted in increased weight, system complexity, and expense. It is therefore desirable to provide simpler, lighter weight, and less expensive solutions for overcoming cavitation issues based on suction line pressure drops.

SUMMARY

In one aspect, a hydraulic fluid subsystem supports a primary hydraulic fluid system. The hydraulic fluid subsystem includes a plurality of fluidly connected components, including an engine operable to drive a hydraulic pump, the hydraulic pump, and a suction line connected to the pump. The subsystem also includes an accumulator in direct fluid communication with the suction line, with the accumulator operable to rapidly supply pressurized hydraulic fluid into the suction line in response to instantaneous pressure drops in the suction line. Finally, the subsystem includes an engine nacelle that encompasses the plurality of fluidly connected components.

In another aspect, an architectural arrangement for a hydraulic fluid subsystem includes a nacelle containing an engine, a hydraulic pump driven by the engine, a suction line connected to the hydraulic pump, and a hydraulic accumulator in direct fluid communication with the suction line. The accumulator is operable to rapidly supply pressurized hydraulic fluid into the suction line in response to instantaneous pressure drops in the suction line to prevent cavitation in the pump.

In yet another aspect, a method of applying a hydraulic accumulator directly to a pump suction line to prevent cavitation in a pump when the pump is located remotely from a hydraulic fluid reservoir includes:

a) acquiring an accumulator and installing the accumulator proximal to the pump;
b) establishing a fluid connection between the accumulator and the pump suction line;
c) placing each of the hydraulic accumulator, the suction line, and the pump are contained within the nacelle of an engine;
d) confirming that hydraulic fluid is fed to the accumulator from the hydraulic fluid reservoir; and
e) confirming that upon transient pressure drops in suction line, pressurized volumes of hydraulic fluid are rapidly released from the accumulator into the pump suction line.

Additional aspects of the disclosures provided herein may be further appreciated via examples and advantages provided, with reference to the following description and drawings.

DETAILED DESCRIPTION

Figure 1:
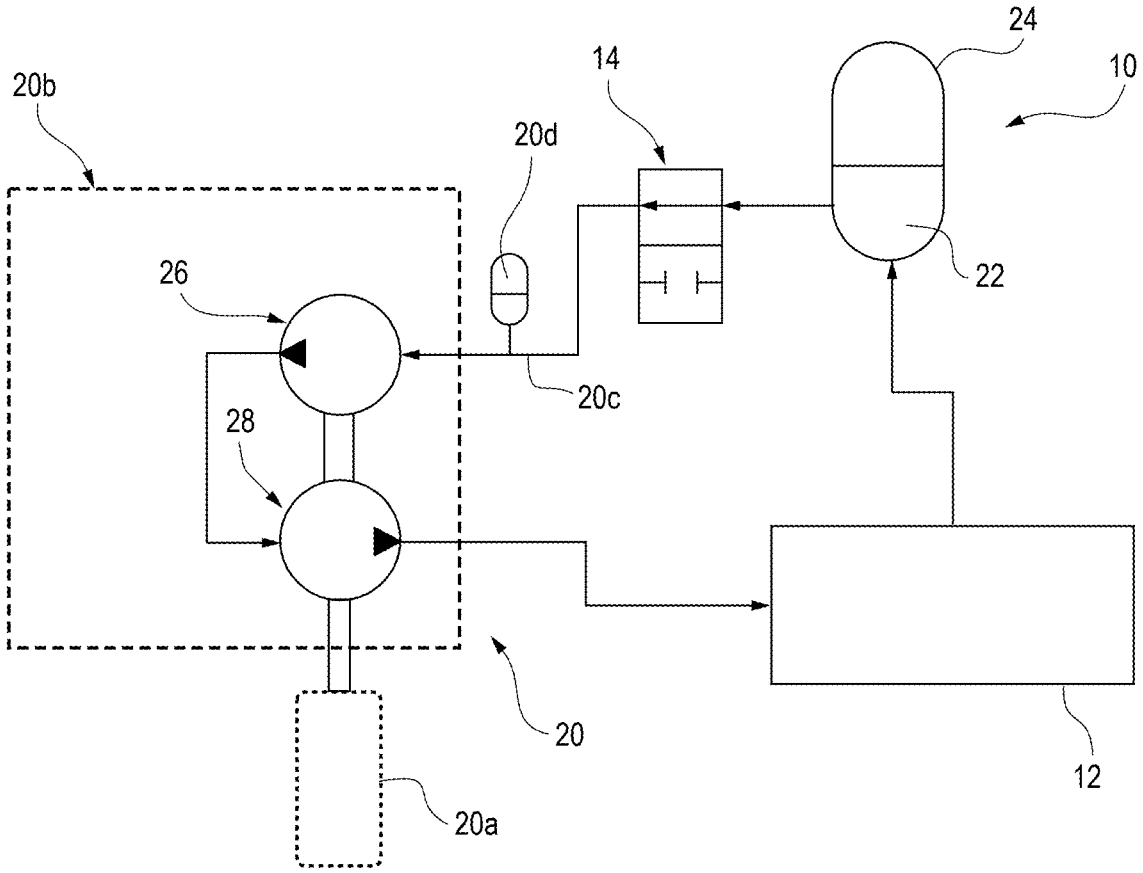
FIG. 1 is a schematic view of a plurality of low pressure hydraulic fluid components in an embodiment of a hydraulic fluid subsystem, as may be configured in accordance with this disclosure.

Referring to FIG. 1, a hydraulic fluid subsystem 10 supports a primary hydraulic fluid system 12. The subsystem 10 is a low pressure hydraulic fluid system, while the primary hydraulic fluid system 12 is a high pressure system. In commercial and military aircraft environments, the low pressure subsystem 10 will typically operate at or under 30 psi, for example about 25 psi. The high pressure system 12 will typically operate around 3,000 psi. This disclosure, however, addresses the low pressure subsystem 10, only.

The subsystem 10 includes a plurality of fluidly connected components 20 including an engine 20*a*, a hydraulic fluid pump 20*b* driven by the engine 20*a* which pumps hydraulic fluid 22, a suction line 20*c* connected to the pump, and an accumulator 20*d* in direct fluid communication with the suction line 20*c*. The hydraulic fluid 22 is supplied to the subsystem from a hydraulic fluid reservoir 24, which may be positioned remotely from the subsystem 10 by up to 50 feet away in a typical aircraft arrangement. Such distance of the reservoir from the pump can give rise to substantial line pressure losses, particularly when spontaneous activations of the pumps produce instantaneous accelerations of hydraulic fluids from low to high flow conditions. Finally, an automatically actuated firewall shutoff valve 14 separates the reservoir 24 from the fluidly connected components 20 including the engine 20*a*.

Such accelerations of hydraulic fluids cause momentary rapid decreases in pressures occurring within the hydraulic pump suction line 20*c*, creating cavitation, which over time can damage impellers and other pump components, and eventually result in pump failures. The disclosed engine-driven hydraulic fluid pump 20*b* is a dual stage pump, defined by an inlet boost impeller 26 as a first stage, which is situated directly upstream of a variable piston pump 28, as a second stage. To prevent cavitation damage to the hydraulic fluid pump 20*b*, the low pressure accumulator 20*d* can be installed and fluidly connected to the suction line 20*c* near the inlet boost impeller 26 to boost suction line pressures during instantaneous demands that call for higher pump flows. The boost in suction line pressure can be assured because fluid from the accumulator is directly and spontaneously injected into the suction line to counter pressure drops. As such, the accumulator 20*d* can function as a type of localized reservoir for the engine-driven pump 26 to avoid deleterious pressure drops that give rise to cavitation. The accumulator 20*d* stores and maintains pressurized volumes of hydraulic fluid during steady state operation of the pump. It can be sized with sufficient capacity to avoid pressures in the suction line 20*c* to ever fall below a predetermined minimum thresholds. It should be noted that the variable piston pump 28 operates immediately downstream of the inlet boost impeller 26. The variable piston pump 28 interacts directly with the primary hydraulic fluid system 12, the earlier noted high pressure system supported by the subsystem 10.

Figure 2:
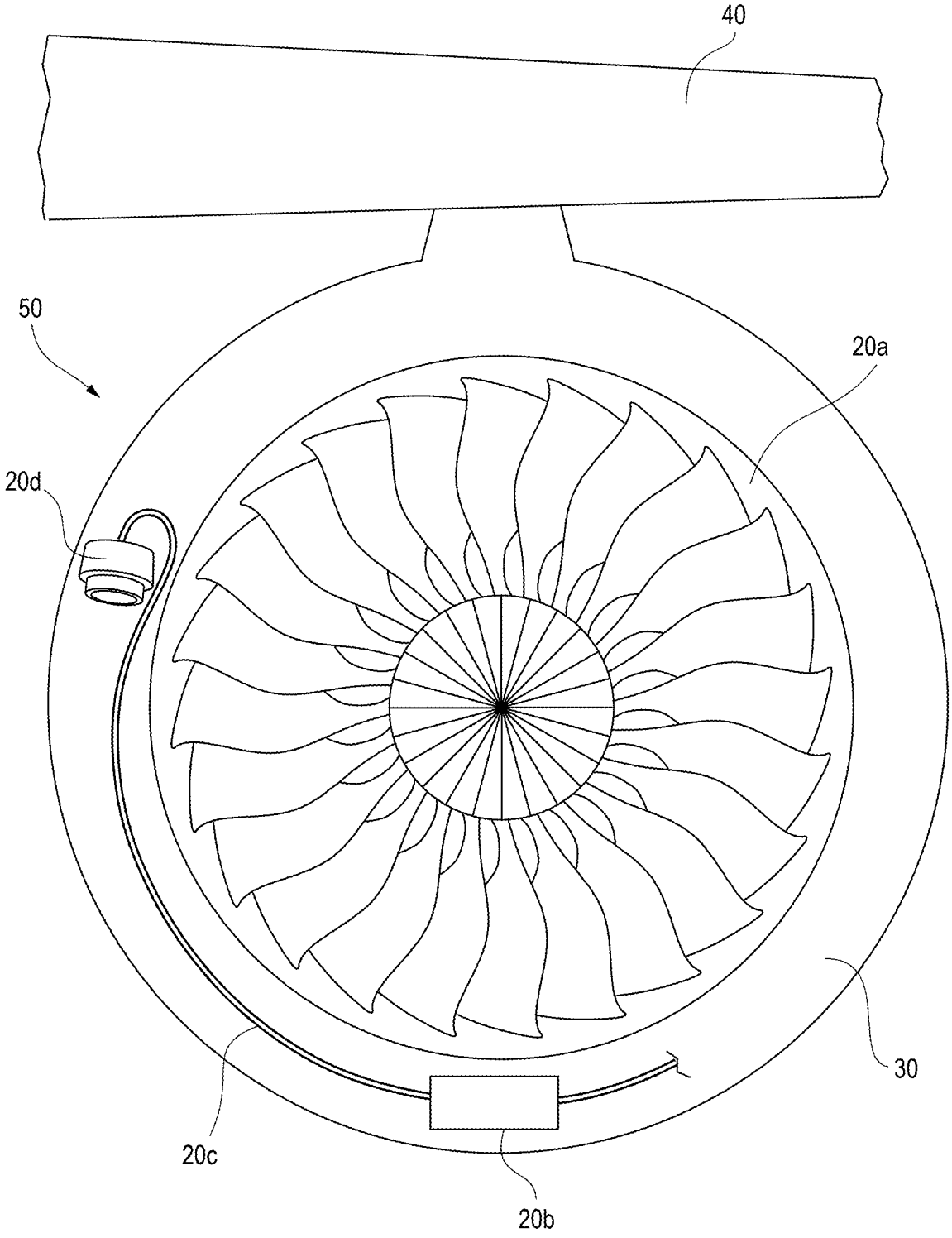
FIG. 2 is an architectural arrangement of components of the hydraulic fluid subsystem of FIG. 1, shown situated within the nacelle of a jet engine, in accordance with an embodiment of this disclosure.

Referring now to FIG. 2, one disclosed architectural arrangement 50 provides for the low pressure accumulator 20*d* to be directly coupled to the suction line 20*c* of an aircraft engine-driven hydraulic pump 20*b* to supply hydraulic fluid upon demand. The arrangement 50 provides that both the pump and accumulator are contained within an aircraft engine nacelle 30. As depicted, the engine 20*a* is mounted to and suspended from an aircraft wing 40 (shown only partially). The accumulator 20*d* operates fully independently of any remote main aircraft accumulator (not shown, but part of system 12 in FIG. 1), and while such main accumulator generally employs a nitrogen-filled bladder, operates at thousands of psi, and requires periodic service, the low pressure accumulator 20*d* operates at or less than 30 psi, and is formed of maintenance-free construction, as will be described.

Figure 3:
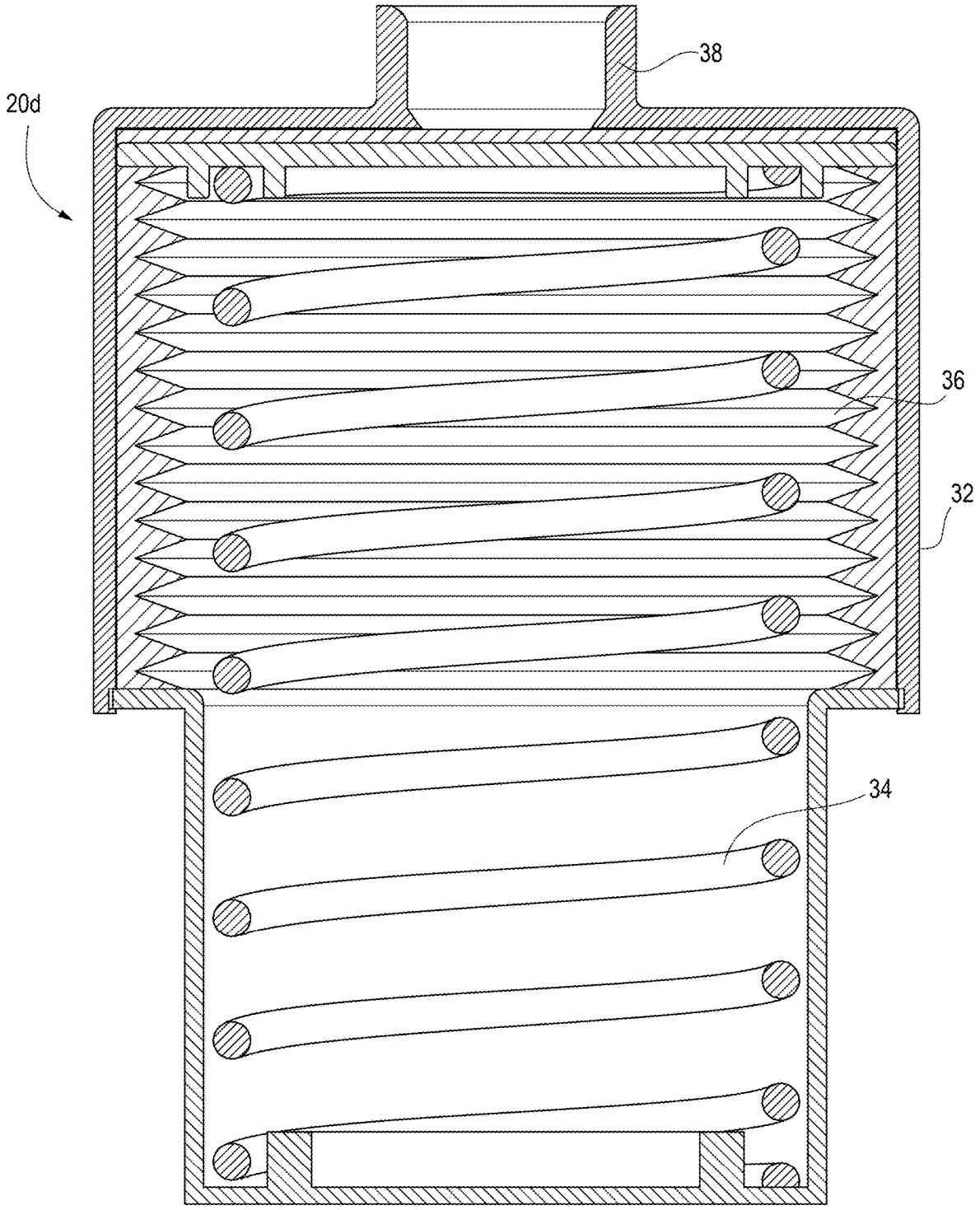
FIG. 3 is a cross-sectional view of an embodiment of one component of the hydraulic fluid subsystem, as may be constructed in accordance with this disclosure.

FIG. 3 depicts an exemplary low-pressure, low inertia, spring energized metal bellows-styled accumulator 20*d*, which contains maintenance-free components, all formed of metal. As such, the accumulator 20*d* includes no elastomeric or non-metal components that might otherwise rely upon sliding elastomeric seals subject to deterioration and wear due to friction. Under wide swings of pressures and temperatures to which aircraft operations are subject, hermetic sealing of the metal bellows 36 permits atmospheric venting, and otherwise avoids risk of leakage through elastomeric seals or bladder parts. Such avoidance of friction also improves performance in low pressure applications. The use of hermetic sealing of vacuum pressure inside of the metal bellows 36, or atmospherically venting of the bellows 36, allows for optimal performance under wide swings of atmospheric pressures and temperatures to which aircraft operations are subject. In addition, the metal bellows 36 offers lower inertia than traditional piston heads, thus facilitating quicker response times.

The low-pressure accumulator 20*d* contains components including a housing 32, a low inertia coil spring 34, and a spring-loaded metal bellows 36. Use of the spring 34 for energizing the accumulator permits its maintenance-free use within a jet engine nacelle. Significant swings in temperatures could otherwise create any gaseous pre-charges to exceed pressure limits, thus rendering the accumulator ineffective at extreme temperatures. The use of the spring also eliminates the possibility of a gas chamber exploding during a fire, or during battle in the case of a military operation. Finally, the use of the spring requires no scheduled maintenance as would be required by a gaseous accumulator.

Although the accumulator 20*d* is displayed in a non-loaded configuration, it will be appreciated by those skilled in the art that when the accumulator is loaded the vent 38 will permit the accumulator to be atmospherically vented, or alternatively vacuum sealed. Atmospheric venting will prevent pressure build-ups from trapped air subject to wide temperature variations, and will thus allow the differential pressures in the accumulator to follow differential pressures experienced by the reservoir during various changes in altitude. As such, it is a significant advantage that the accumulator contains no sealed gas chamber as would normally be employed in a typical bladder-styled accumulator, such as in the primary system 12 (of FIG. 1).

Demonstration of Proof of Principle

Figure 4:
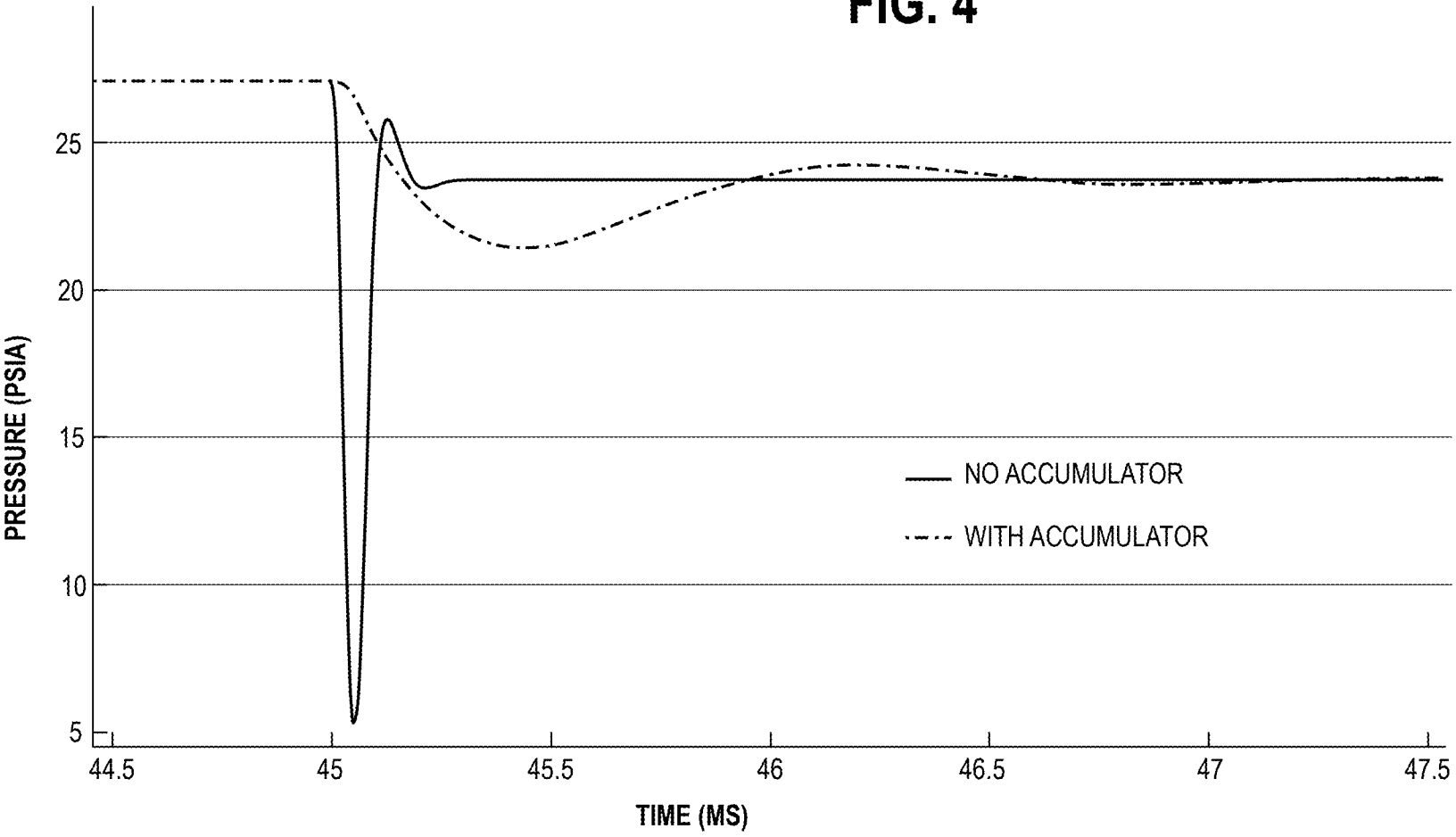
FIG. 4 is a graph displaying a measurable difference made by the component of FIG. 2 in response to an instantaneous pressure drop in the suction line to avoid cavitation, in accordance with an embodiment of this disclosure.

FIG. 4 is graph depicting anticipated effectiveness of the disclosed low-pressure accumulator 20*d* when placed in the suction line 20*c* adjacent the inlet boost impeller 26. The graph was generated by commercially available software EASY5 by Hexagon, which provided a high fidelity physics-based modeling of the disclosed low pressure subsystem, using applied physical property parameters of the reservoir, suction line, hydraulic fluid pump, and the low pressure accumulator. The modeling was based upon predicted pump inlet pressures under instantaneous system load demands.

The solid line reflects the disclosed system without inclusion of an accumulator, while the dotted line reflects the presence of the accumulator 20*d*. The graph shows a relationship of pressure drop vs. time whenever the pump is spontaneously activated, causing acceleration of hydraulic fluids, and creating a sudden rapid decrease of pressure in the hydraulic pump suction line 20*c*. Such response produces cavitation, which can over time damage the pump, and eventually result in pump failures, as has been described. The graph reflects change in the pressure in pounds per square inch versus time in milliseconds, under an instantaneous pump activation surge. The substantial pressure drop of the solid line (no accumulator) can be responsible for deleterious cavitation as described.

Method

Figure 5:
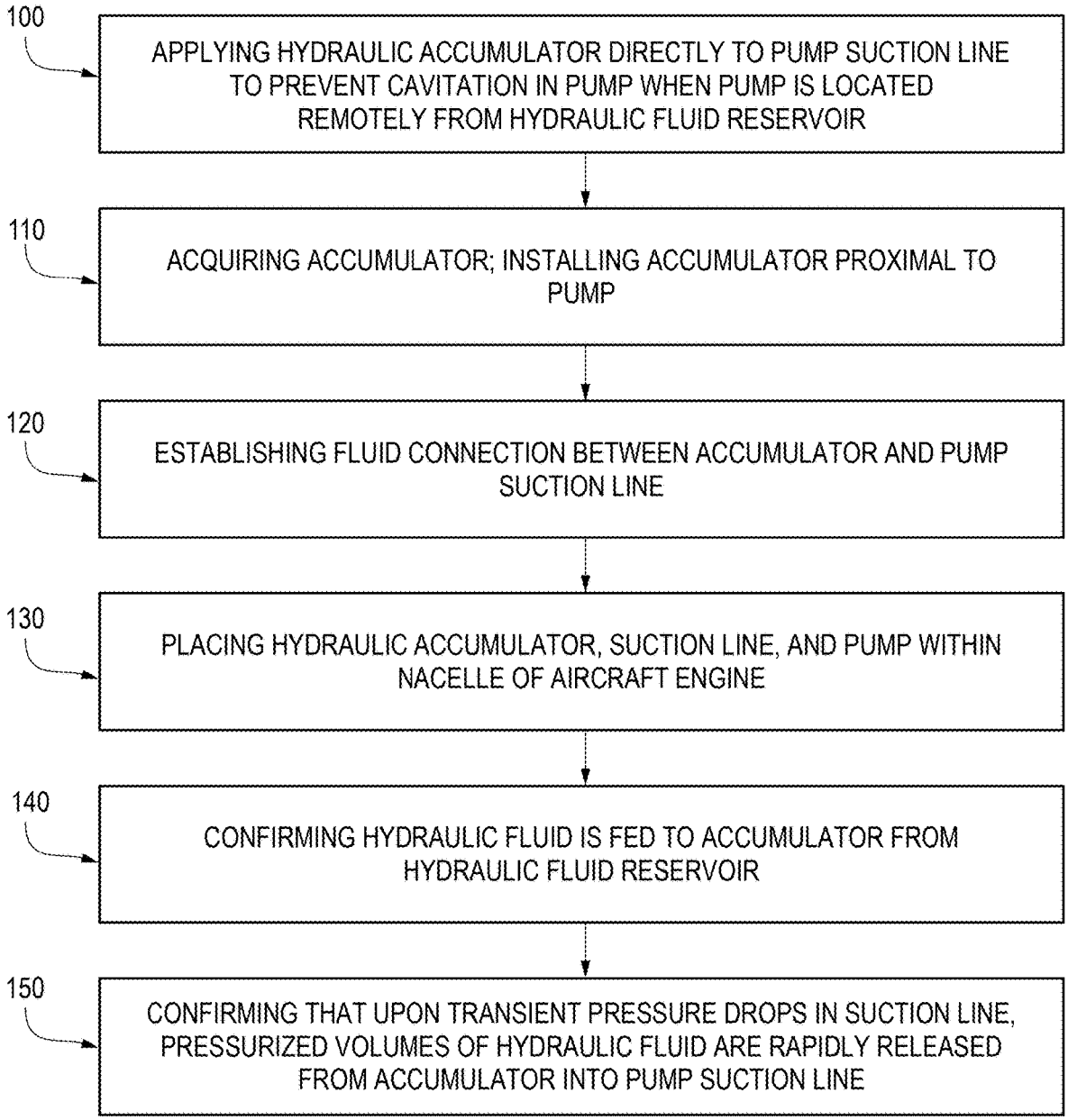
FIG. 5 is a Flowchart describing one disclosed method of avoiding cavitation.

Referring now also to FIG. 5, a method 100 of applying a hydraulic accumulator 20*d* directly to a pump suction line 20*c* to prevent cavitation in a pump 26 when the pump is located remotely from a hydraulic fluid reservoir 24 can be described as follows:

a) 110: acquiring an accumulator 20*d* and installing the accumulator proximal to the pump 26;

b) 120: establishing a fluid connection between the accumulator 20*d* and the pump suction line 20*c;* c) 130: placing each of the hydraulic accumulator 20*d*, the suction line 20*c*, and the pump 26 are contained within the nacelle 30 of an engine 20*a;* d) 140: confirming that hydraulic fluid 22 is fed to the accumulator 20*d* from the hydraulic fluid reservoir 24; and e) 150: confirming that upon transient pressure drops in suction line 20*c*, pressurized volumes of hydraulic fluid 22 are rapidly released from the accumulator 20*d* into the pump suction line 20*c*.

Although a subsystem, an architectural arrangement, and a method has been disclosed for avoiding cavitation damage to pumps while assuring optimal system performance, modifications of the disclosed subsystem, arrangement, and method may occur to those skilled in the art. Among other advantages, the disclosed accumulator 20*d* will inherently permit greater distances and/or separation of reservoirs from hydraulic fluid pumps. Although this disclosure has been limited primarily to aircraft environments, other environments including industrial and commercial settings may be able to utilize the benefits of this disclosure. Thus, the disclosure, including any modifications thereof, shall be considered limited only by the scope of the appended claims.

CLAUSES

Clause 1. A hydraulic fluid subsystem supporting a primary hydraulic fluid system; the hydraulic fluid subsystem comprising:

a plurality of fluidly connected components including an engine, a pump driven by the engine, a suction line connected to the pump, and an accumulator in direct fluid communication with the suction line, the accumulator operable to rapidly supply hydraulic fluid into the suction line in response to instantaneous pressure drops in the suction line; and wherein the subsystem further comprises a nacelle that encompasses the plurality of fluidly connected components.

Clause 2. The hydraulic fluid subsystem of Clause 1, wherein the accumulator is supplied by a pressurized hydraulic fluid reservoir positioned outside of the nacelle.

Clause 3. The hydraulic fluid subsystem of Clauses 1-2, wherein the hydraulic fluid pump driven by the engine comprises an inlet boost impeller and a variable piston pump.

Clause 4. The hydraulic fluid subsystem of Clauses 1-3, wherein the inlet boost impeller is positioned immediately downstream of the accumulator.

Clause 5. The hydraulic fluid subsystem of Clauses 1-4, wherein the variable piston pump is positioned downstream of the inlet boost impeller.

Clause 6. The hydraulic fluid subsystem of Clauses 1-5, wherein the accumulator comprises a spring-loaded metal bellows that vents to atmosphere.

Clause 7. The hydraulic fluid subsystem of Clauses 1-6, wherein the accumulator stores pressurized volumes of hydraulic fluid during steady state operation of the pump.

Clause 8. The hydraulic fluid subsystem of Clauses 1-7, wherein the accumulator releases the pressurized volumes of hydraulic fluid during transient drops in suction line pressure.

Clause 9. An architectural arrangement for a hydraulic fluid subsystem comprising:

a nacelle containing a plurality of fluidly connected components including an engine, a pump driven by the engine, a suction line connected to the pump, and an accumulator in direct fluid communication with the suction line; and wherein the accumulator is operable to prevent pump cavitation by rapidly supplying pressurized hydraulic fluid into the suction line in response to instantaneous pressure drops in the suction line.

Clause 10. The architectural arrangement of Clause 9, wherein the accumulator is supplied by a pressurized hydraulic fluid reservoir positioned outside of the nacelle and remotely upstream of the accumulator.

Clause 11. The architectural arrangement of Clauses 9-10, wherein the hydraulic fluid pump comprises an inlet boost impeller and a variable piston pump.

Clause 12. The architectural arrangement of Clauses 9-11, wherein the inlet boost impeller is positioned immediately downstream of the accumulator.

Clause 13. The architectural arrangement of Clauses 9-12, wherein the variable piston pump is positioned downstream of the inlet boost impeller.

Clause 14. The architectural arrangement of Clauses 9-13, wherein the accumulator comprises a spring-loaded metal bellows that vents to atmosphere.

Clause 15. The architectural arrangement of Clauses 9-14, wherein the accumulator stores pressurized volumes of hydraulic fluid during steady state operation of the pump, and releases the stored pressurized volumes during transient drops in suction line pressure.

Clause 16. A method of applying a hydraulic accumulator directly to a pump suction line to prevent cavitation in a pump when the pump is located remotely from a hydraulic fluid reservoir; the method comprising:

a) acquiring an accumulator and installing the accumulator proximal to the pump;

b) establishing a fluid connection between the accumulator and the pump suction line;

c) placing each of the hydraulic accumulator, the pump suction line, and the pump within the nacelle of an engine;

d) confirming that hydraulic fluid is fed to the accumulator from the hydraulic fluid reservoir; and e) confirming that upon transient pressure drops in the pump suction line, pressurized volumes of hydraulic fluid are rapidly released from the accumulator into the pump suction line.

Clause 17. The method of Clause 16, wherein the accumulator stores and maintains pressurized volumes of hydraulic fluid during steady state operation of the pump.

Clause 18. The method of Clauses 16-17, wherein the accumulator comprises a spring-loaded metal bellows that vents to atmosphere.

Clause 19. The method of Clauses 16-18, wherein the pump is an engine driven pump positioned immediately downstream of the accumulator.

Clause 20. The method of Clauses 16-19, wherein the pump is an aircraft engine driven pump.

What is claimed is:

1. A hydraulic fluid subsystem for use with a nacelle of an aircraft, the subsystem comprising:

a pump driven by an engine of the nacelle, a suction line connected to the pump, and an accumulator in direct fluid communication with the suction line, the accumulator positioned on the nacelle and operable to supply hydraulic fluid into the suction line in response to pressure drops in the suction line, the accumulator supplied by a fluid reservoir that is upstream of the accumulator and external to the nacelle, wherein the accumulator includes a spring-loaded bellows that vents to atmosphere.

2. The hydraulic fluid subsystem of claim 1, wherein the pump driven by the engine comprises an inlet boost impeller and a variable piston pump.

3. The hydraulic fluid subsystem of claim 2, wherein the inlet boost impeller is positioned immediately downstream of the accumulator.

4. The hydraulic fluid subsystem of claim 2, wherein the variable piston pump is positioned downstream of the inlet boost impeller.

5. The hydraulic fluid subsystem of claim 1, wherein the accumulator comprises the spring-loaded bellows is metal.

6. The hydraulic fluid subsystem of claim 1, wherein the accumulator stores pressurized volumes of the hydraulic fluid during steady state operation of the pump.

7. The hydraulic fluid subsystem of claim 6, wherein the accumulator releases the pressurized volumes of the hydraulic fluid during transient drops in pressure in the suction line.

8. The hydraulic fluid subsystem of claim 1, wherein the bellows is hermetically sealed.

9. The hydraulic fluid subsystem of claim 1, wherein the bellows includes an elastomeric seal or a bladder.

10. The hydraulic fluid subsystem of claim 1, wherein the accumulator is sealed containing vacuum pressure.

11. An architectural arrangement for a hydraulic fluid subsystem, the architectural arrangement comprising:

a nacelle supporting an engine, a pump driven by the engine, a suction line connected to the pump, and an accumulator in direct fluid communication with the suction line, the accumulator supplied by a fluid reservoir that is upstream of the accumulator and external to the nacelle; and wherein the accumulator is operable to prevent pump cavitation by rapidly supplying pressurized hydraulic fluid into the suction line in response to instantaneous pressure drops in the suction line, wherein the accumulator includes a spring-loaded bellows that vents to atmosphere.

12. The architectural arrangement of claim 11, wherein the pump comprises an inlet boost impeller and a variable piston pump.

13. The architectural arrangement of claim 12, wherein the inlet boost impeller is positioned immediately downstream of the accumulator.

14. The architectural arrangement of claim 12, wherein the variable piston pump is positioned downstream of the inlet boost impeller.

15. The architectural arrangement of claim 11, wherein the bellows that vents to atmosphere includes metal.

16. The architectural arrangement of claim 11, wherein the accumulator stores pressurized volumes of the hydraulic fluid during steady state operation of the pump, and releases the stored pressurized volumes during transient drops in pressure of the suction line.

17. The architectural arrangement of claim 11, wherein the accumulator is sealed containing vacuum pressure.

18. A method of applying a hydraulic accumulator to a pump suction line to prevent cavitation in a pump when the pump is located remotely from a hydraulic fluid reservoir; the method comprising:

a) installing the accumulator proximal to the pump;

b) establishing a fluid connection between the accumulator and the pump suction line;

c) placing each of the hydraulic accumulator, the pump suction line, and the pump within a nacelle of an engine;

d) confirming that hydraulic fluid is fed to the accumulator from the hydraulic fluid reservoir; and e) confirming that upon transient pressure drops in the pump suction line, pressurized volumes of the hydraulic fluid are rapidly released from the accumulator into the pump suction line.

19. The method of claim 18, wherein the accumulator stores and maintains the pressurized volumes of the hydraulic fluid during steady state operation of the pump.

20. The method of claim 18, wherein the accumulator comprises a spring-loaded metal bellows that vents to atmosphere.

21. The method of claim 18, wherein the pump is an engine driven pump positioned immediately downstream of the accumulator.

22. The method of claim 18, wherein the pump is an aircraft engine driven pump.

23. The method of claim 18, wherein the accumulator is sealed containing vacuum pressure.

* * * * *